US006810222B2

(12) United States Patent
Ohyama

(10) Patent No.: US 6,810,222 B2
(45) Date of Patent: Oct. 26, 2004

(54) IMAGE FORMING APPARATUS INCLUDING AN IMAGE CARRIER, A LATENT IMAGE FORMING MEANS, AND A DEVELOPING DEVICE CAPABLE OF PREVENTING DEVELOPER FROM ESCAPING THE DEVELOPING DEVICE, AND PROCESS CARTRIDGE THEREFORE

(75) Inventor: Kunihiro Ohyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 10/229,008

(22) Filed: Aug. 28, 2002

(65) Prior Publication Data

US 2003/0044197 A1 Mar. 6, 2003

(30) Foreign Application Priority Data

Aug. 29, 2001 (JP) ..... 2001-259646

(51) Int. Cl.[7] ..... G03G 15/08; G03G 15/09

(52) U.S. Cl. ..... 399/104; 399/275; 399/277

(58) Field of Search ..... 399/103, 104, 399/267, 275, 277

(56) References Cited

U.S. PATENT DOCUMENTS 4,465,359 A * 8/1984 Nakahata ..... 399/275
4,580,888 A 4/1986 Thompson et al.
4,676,191 A * 6/1987 Kojima et al. ..... 399/104
4,838,200 A * 6/1989 Hosoi et al. ..... 399/104
4,887,130 A * 12/1989 Yuge et al. ..... 399/104
4,936,249 A * 6/1990 Tajima et al. ..... 399/275
5,065,693 A * 11/1991 Yoshino et al. ..... 399/104
6,208,826 B1 3/2001 Yoshinaga et al. ..... 399/318

FOREIGN PATENT DOCUMENTS

| | | | | |
|---|---|---|---|---|
| JP | 56-92554 | | 7/1981 | |
| JP | 61-36773 | | 2/1986 | |
| JP | 6-64396 | | 8/1994 | |
| JP | 8-30098 | | 2/1996 | |
| JP | 8-33692 | | 3/1996 | |
| JP | 09-006139 | * | 1/1997 | ..... G03G/15/08 |
| JP | 9-152778 | | 6/1997 | |
| JP | 2001-125382 | * | 5/2001 | ..... G03G/15/08 |

* cited by examiner

*Primary Examiner*—Fred Braun
(74) *Attorney, Agent, or Firm*—Oblon, Spivak, McClelland, Maier & Neustadt, P.C.

(57) ABSTRACT

An image forming apparatus of the present invention includes a developing device including a sleeve and a magnet roller fixedly accommodated in the sleeve. The magnet roller includes a main magnetic pole and an auxiliary magnetic pole adjoining it at a downstream side in the direction of rotation of the sleeve. A magnetic collection pole is positioned on the edge of an opening formed in a casing and facing a photoconductive drum. The collection pole forms a magnetic field that prevents a developer falling away from the sleeve from escaping the developing device via the opening.

16 Claims, 12 Drawing Sheets

IMAGE FORMING APPARATUS INCLUDING AN IMAGE CARRIER, A LATENT IMAGE FORMING MEANS, AND A DEVELOPING DEVICE CAPABLE OF PREVENTING DEVELOPER FROM ESCAPING THE DEVELOPING DEVICE, AND PROCESS CARTRIDGE THEREFORE

BACKGROUND OF THE INVENTION

1. Field of the Invention

The present invention relates to a copier, printer, facsimile apparatus or similar electrophotographic image forming apparatus and a process cartridge therefor. More particularly, the present invention relates to an electrophotographic image forming apparatus including an image carrier, latent image forming means for forming a latent image on the image carrier and a developing device for developing the latent image with toner and a process cartridge therefor.

2. Description of the Background Art

It is a common practice with an electrophotographic image forming apparatus to form a latent image on an image carrier, e.g., a photoconductive drum or belt in accordance with image data and develop the latent image with a developing device for thereby producing a corresponding toner image. The image forming apparatus uses either one of a one-ingredient type developer, i.e., toner and a two-ingredient type developer made up of toner and magnetic grains. A developing system of the type using the two-ingredient type developer is desirable in the aspect of image transfer and stability against temperature and humidity. In this type of developing system, the developer rises on a developer carrier in the form of a magnet brush in a developing zone where the developer carrier faces the image carrier, so that the toner is fed from the magnet brush to the latent image.

However, a conventional developing system using the tow two-ingredient type developer has a problem to be described later in detail.

Japanese Patent Laid-Open Publication No. 9-152778, for example, discloses a developing device in which an auxiliary magnet faces a magnetic pole configured to retain a developer. The auxiliary magnet, which is of the same polarity as the magnetic pole, is positioned outside of a casing or storing means for storing a developer. In this configuration, the frictional resistance of the bottom of the casing acting on the developer is reduced to insure the fluidity of the developer collected after development, thereby preventing the developer from accumulating on the bottom of the casing. This kind of scheme, however, is not directed toward the collection of a developer falling off the developer carrier. Further, the magnetic force of the auxiliary magnet facing the developer retaining pole is likely to decrease.

Technologies relating to the present invention are also disclosed in, e.g., Japanese Patent Laid-Open Publication No. 8-30098 and Japanese Patent Publication Nos. 6-64396 and 8-33692.

SUMMARY OF THE INVENTION

It is an object of the present invention to provide an image forming apparatus capable of preventing a developer falling off the developer carrier from escaping the developing device and a process cartridge therefor.

An image forming apparatus of the present invention includes an image carrier, a latent image forming device for forming a latent image on the image carrier, and a developing device for developing the latent image to thereby produce a corresponding toner image. The developing device includes a casing for storing a developer consisting of toner and magnetic grains and is formed with an opening facing the image carrier. A rotatable developer carrier is supported in the casing and formed of a nonmagnetic material. A magnetic field generating device causes the developer to rise in the form of a magnet brush on the developer carrier in a developing zone that faces the image carrier. The magnetic field generating device is implemented by a main magnetic pole positioned inward of the developer carrier with respect to the developing zone and an auxiliary magnetic pole positioned downstream of the main magnetic pole in the direction of rotation of the developer carrier and opposite in polarity to the main magnetic pole. A magnetic field forming member is disposed in the casing for forming a magnetic field that prevents the developer falling off the developer carrier from escaping the developing device via the opening. The magnet brush on the developer carrier is moved in the same direction as the surface of the image carrier, as viewed in the developing zone, but at a higher speed than the surface of the image carrier in contact with the surface of the image carrier, thereby developing the latent image.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, brief reference will be made to a conventional developing device using a two-ingredient type developer, shown in FIG. 1. As shown, the developing device includes a magnet roller 5. A plurality of magnets are positioned on the surface of the magnet roller 5, and each forms a particular magnetic pole extending radially outward from the magnet roller 5 and in the axial direction of the magnet roller 5. More specifically, a main pole P1 (N pole) is positioned in a developing zone D and causes the developer to rise in the form of brush chains or a magnet brush. Auxiliary poles P1*a* (S pole) and P1*b* (S pole) adjoin the main pole P1 at the upstream side and downstream side, respectively, in the direction of rotation of a sleeve 4 that accommodates the magnet roller 5. A pole P4 (N pole) is positioned between a separating member edge 7*a* and the developing zone D, exerting a magnetic force on a developer chamber S. Further, poles P2 (N pole) and P3 (S pole) convey the developer deposited on the sleeve 4.

Figure 1:
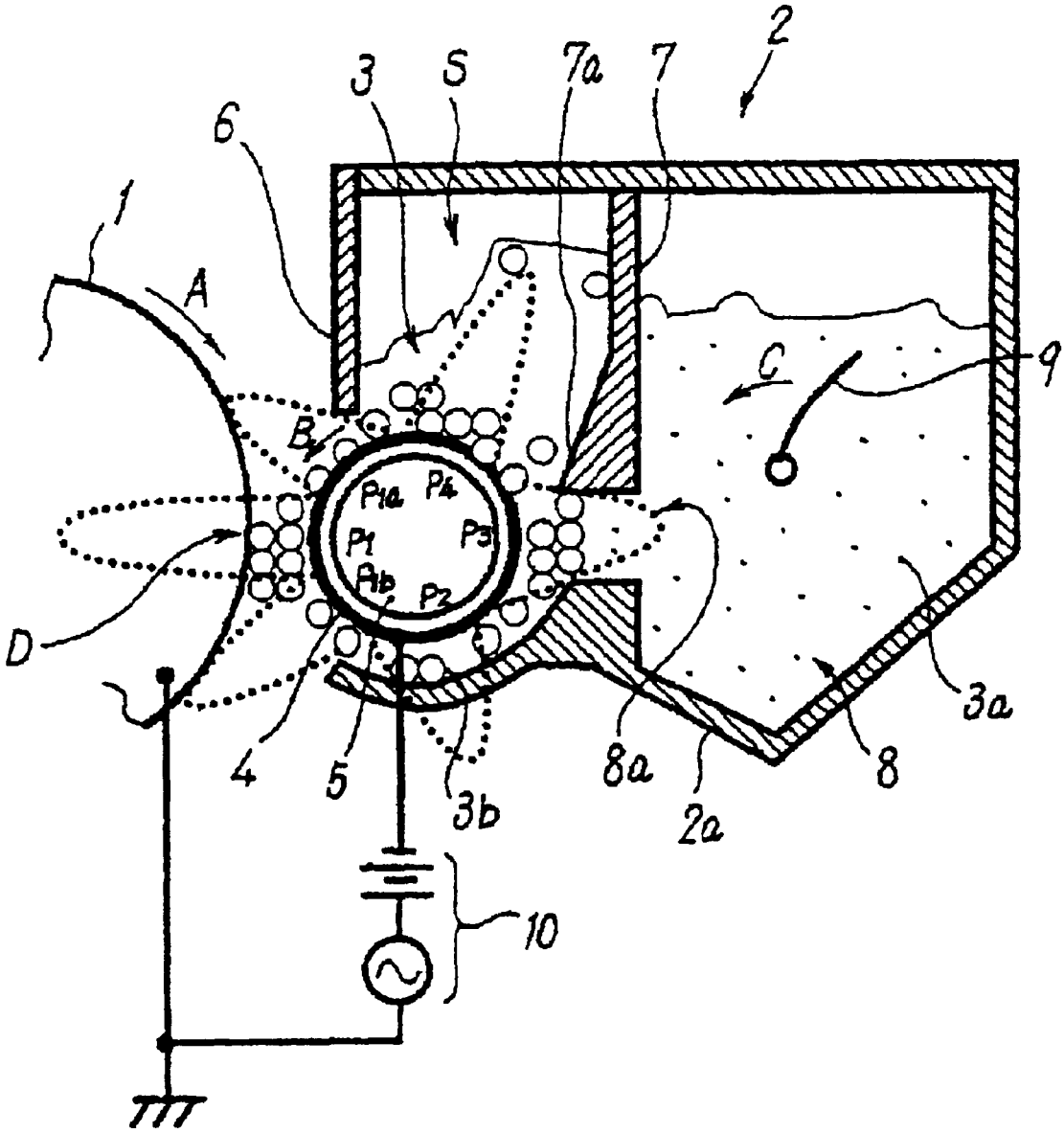
FIG. 1 shows a developing device included in an image forming apparatus embodying the present invention.

In FIG. 1, dotted curves around the sleeve 4 are representative of flux densities formed by the various poles P1 through P4 in the direction normal to the surface of the sleeve 4.

The configuration described above reduces the width of the developing zone D (nip width for development) or increases the density of the magnet brush in the developing zone, thereby reducing or eliminating the omission of the trailing edge of an image, which will be described specifically later, as well as other image defects.

The auxiliary poles P1*a* and P1*b* opposite in polarity to the main pole P1 serve to reduce the angular half width of the flux density distribution formed by the main pole P1 in the normal direction. If the forces of the auxiliary electrodes P1*a* and P1*b* for retaining the developer yield to a centrifugal force when the sleeve 4 is in rotation, then the developer is released. This is presumably ascribable to the as follows phenomenon. The magnets are formed of, e.g., an alloy of rare earth metal in order to reduce the angular half width. A magnet formed of such an alloy exerts a greater magnetic force than a traditional ferrite magnet, so that the angular half width can be reduced if its sectional area is reduced. However, a decrease in sectional area directly translates into an increase in the attenuation ratio of the magnetic force. As a result, a force with which magnetic carrier grains adhere together at the tip of each brush chain is reduced, causing the carrier grains and therefor the developer to release.

The developer falling away from the sleeve 4 at a position corresponding to the auxiliary pole P1*a* is not critical because it enters the developing zone D at the downstream side. However, part of the developer falling away from the sleeve 4 at a position corresponding to the other auxiliary pole P1*b* is scattered around without being collected in the casing of the developing device, contaminating structural members outside of the casing or developed images.

Figure 2:
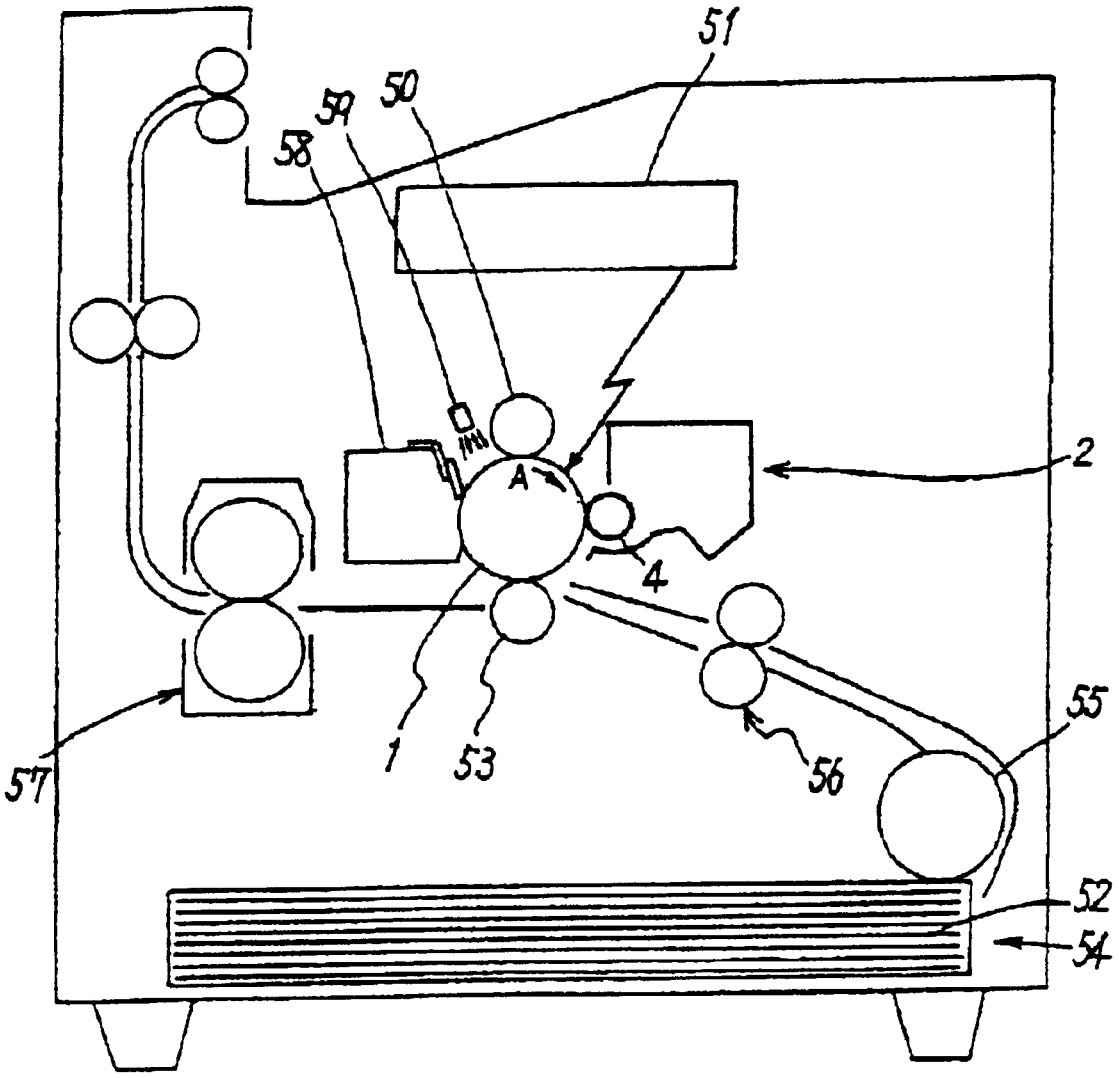
FIG. 2 shows a printer including the developing device of FIG. 1.

Referring to FIG. 2, an image forming apparatus embodying the present invention is shown and implemented as a laser printer by way of example. As shown, the laser printer includes a photoconductive drum or image carrier 1 rotatable in a direction indicated by an arrow A. A charge roller 50 uniformly charges the surface of the drum 1, which is in rotation, in contact with the drum 1. An optical writing unit 51 scans the charged surface of the drum 1 with a laser beam in accordance with image data to thereby form a latent image on the drum 1. While the charge roller 50 and optical writing unit 51 constitute latent image forming means, they may be replaced with any other suitable charger and any other suitable exposing device, respectively.

A developing device 2 including a sleeve 4, which will be described later, develops the latent image formed on the drum 1 for thereby producing a corresponding toner image. An image transferring unit, which includes an image transfer roller 53, transfers the toner image from the drum 1 to a sheet or recording medium 52. The sheet 52 is fed from the sheet cassette 54 via a pickup roller 55 and a registration roller pair 56. The sheet 52 with the toner image is driven out of the print by way of a fixing unit 57. A cleaning unit 58 removes the toner left on the drum 1 after the image transfer. Subsequently, a quenching lamp 59 discharges the surface of the drum 1.

Referring again to FIG. 1, the developing device 2 of the illustrative embodiment will be described in detail. As shown, the sleeve 4 formed of a nonmagnetic material plays the role of a developer carrier on which a developer 3 is deposited. The developer 3 is made up of magnetic toner grains 3*a* and magnetic carrier grains or magnetic grains 3*b*. The sleeve 4 faces the drum 1 through an opening formed in part of a casing 2*a*. A driveline, not shown, causes the sleeve 4 to rotate in such a direction that the developer 3 moves downward (direction B, FIG. 1), as seen at the developing zone D where the sleeve 4 and drum 1 face each other. A magnet roller or magnetic field generating means 5 is fixedly accommodated in the sleeve 4 and has a plurality of stationary magnets.

While the developer 3 deposited on the sleeve 4 is conveyed toward the developing zone D, an outer regulating member 6 regulates the amount of the developer 3. A separating member 7 in combination with the sleeve 4 and outer regulating member 6 form a developer chamber S. The developer 3 is stored in the developer chamber S. A toner hopper 8 stores fresh toner to be replenished to the developer 3. More specifically, the toner hopper 8 is formed with an opening 8*a* adjoining the upstream portion of the developer chamber S in the above direction and facing the surface of the sleeve 4, so that the fresh toner 3*a* can be replenished to the developer 3. An agitator or toner agitating means 9 is disposed in the toner hopper 8 and rotatable in a direction C shown in FIG. 1. The agitator 9 in rotation conveys the fresh toner 3*a* toward the opening 8*a* while agitating it.

The edge of the separating member 7 adjoining the sleeve 4 forms a separating member edge 7*a* that regulates the amount of the developer replenished with the fresh toner 3*a* and moving toward the developer chamber S. The developer chamber S stores the developer blocked by the outer regulating member 6.

A plurality of magnets are arranged on the surface of the magnet roller 5, and each forms a particular magnetic pole in the previously stated manner. More specifically, poles P1, P1*a*, P1*b*, P2, P3 and P4 are positioned on the magnet roller 5 in the configuration stated earlier with reference to FIG. 1. While the magnet roller 5 is shown as having six poles in total, two or four additional poles, for example, may be arranged between the auxiliary pole P1*b* and the auxiliary pole P1*a*, if desired.

The main pole P1 is implemented by a magnet having a small sectional area in a cross-section perpendicular to the axis of rotation of the magnet roller 5. If the magnetic force on the sleeve surface is excessively small, then the carrier grains 3*b* are apt to deposit on the drum 1. In light of this, the magnet forming the main pole P1 is formed of an alloy of rare earth metal. A magnet formed of iron-neodymium-boron alloy, which is a typical rare earth metal alloy, has the maximum energy product of 358 kJ/m$^3$ while a magnet formed of ion-neodymium-boron alloy bond has the maximum energy product of 80 kJ/m$^3$ or so. Such a magnet therefore exerts a greater magnetic force than, e.g., a ferrite magnet whose maximum energy product is 36 kJ/m$^3$ or so or a ferrite bond magnet whose maximum energy product is 20 kJ/m$^3$. This is why even a magnet having a small sectional area can exert a required magnetic force on the sleeve surface.

During development, a bias power supply or bias applying means 10 applies a bias VB for development, which is an oscillating AC-biased DC voltage, to the sleeve 4. A background potential VD and an image potential VL on the drum 1 each are set between the maximum value and the minimum value of the bias VB. The oscillating bias VB forms an alternating electric field in the developing zone D and thereby causes the toner grains 3*a* and carrier grains 3*b* to actively oscillate in the electric field. As a result, the toner grains 3*a* overcome electrostatic and magnetic restriction acting thereon toward the sleeve 4 and carrier grains 3*b* and selectively deposit on a latent image formed on the drum 1.

A difference between the maximum value and the minimum value of the bias VB, i.e., a peak-to-peak voltage should preferably be between 0.5 kV and 5 kV while the frequency of the bias VB should preferably be between 1 kHz and 10 kHz. The bias VB may have a rectangular, sinusoidal, triangular or similar waveform. While the DC component of the bias VB lies between the background potential VD and the image potential VL, it should preferably be closer to the background potential VD than to the image potential VL in order to avoid toner fog.

When the bias VB has a rectangular waveform, a duty ratio of 50% or above should be selected. The duty ratio refers to a ratio of a period of time over which the toner tends to move toward the drum 1 to one period of the bias VB. A duty ratio of 50% or above successfully increases a difference between the peak value at which the toner tends to move toward the drum 1 and the time mean of the bias VB, thereby making the movement of the toner more active. It follows that the toner faithfully deposits on a potential distribution forming a latent image on the drum 1. This not only enhances a developing ability but also improves granularity and resolution. Further, the above duty ratio reduces a difference between the peak value at which the carrier 3*a* tends to move toward the drum 1 and the time mean of the bias VB, thereby settling the movement of the carrier 3*a*. Consequently, this can reduce or eliminate disturbances which would cause the trailing edge of an image to be lost. At the same time, there is enhanced reproducibility of thin lines and solitary dots. In addition, the probability that the carrier 3*a* deposits on the background of a latent image is noticeably reduced.

Figure 3:
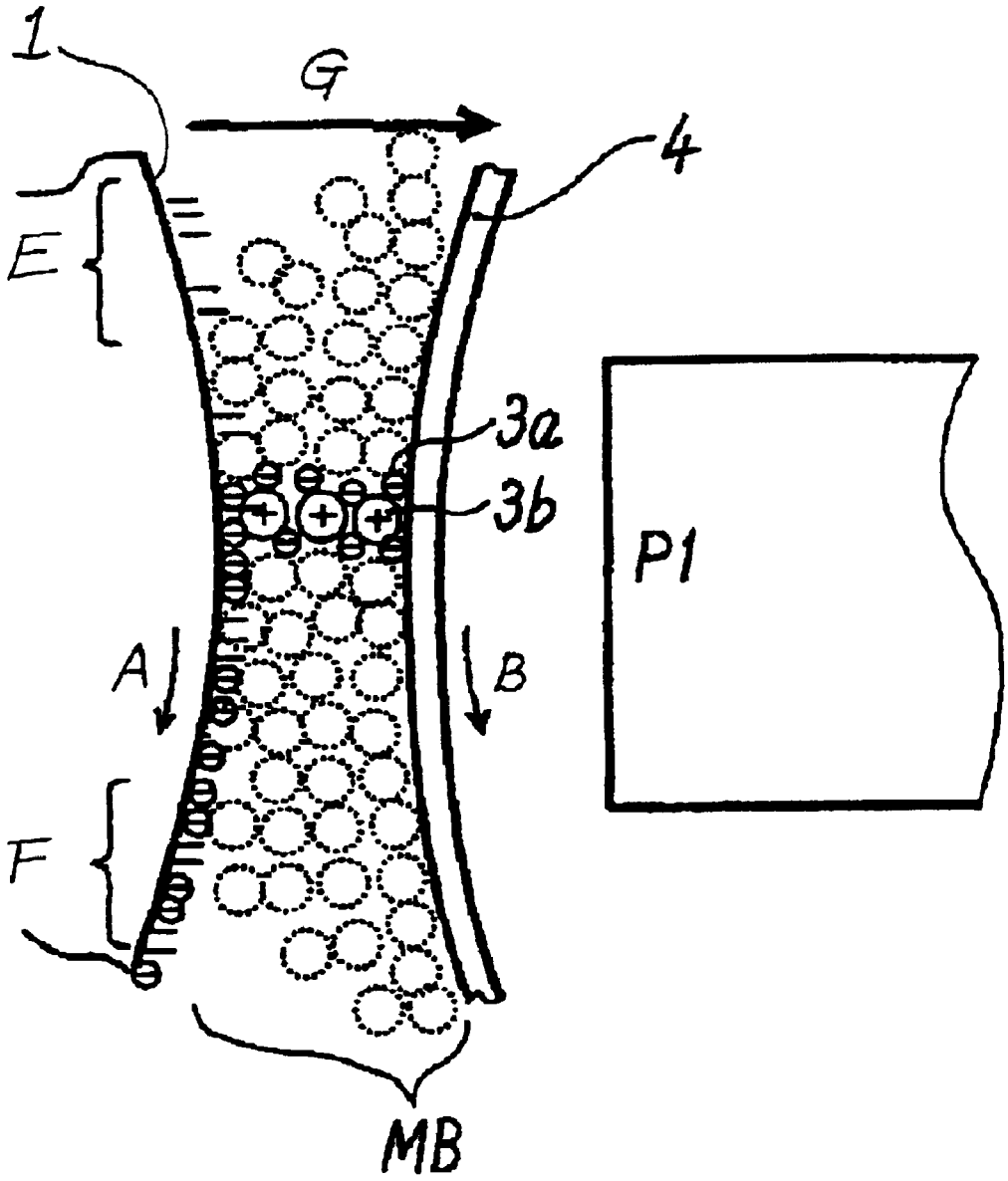
FIG. 3 demonstrates negative-to-positive development to be executed by a developing device using a two-ingredient type developer.

Why the trailing edge of a black solid image or that of a halftone solid image is lost will be described hereinafter with reference to FIG. 3. FIG. 3 shows a specific developing section included in a developing device of the type effecting negative-to-positive development with the two-ingredient type developer. In FIG. 3, small circles and large circles are representative of the toner grains 3*a* and carrier grains 3*b*, respectively. Further, in FIG. 3, only one brush chain in the developing zone is indicated by a solid line while the other brush chains are indicated by phantom lines with toner grains thereof being not shown. A non-image portion E on the drum surface is assumed to be charged to negative polarity.

As shown in FIG. 3, the developer deposited on the sleeve 4 is conveyed toward the developing zone where the sleeve 4 and drum 1 face each other in accordance with the rotation of the sleeve 4. As the developer approaches the developing zone, the carrier grains 3*b* rise in the form of a magnet brush MB due to the magnetic force of the main pole P1. At this instant, the drum 1 is rotating in a direction A while carrying a latent image thereon. In the developing zone, the magnet brush MB rubs the latent image of the drum 1 due to a difference in linear velocity between the drum 1 and the sleeve 4 (the former is lower than the latter). As a result, the toner grains 3*a* deposit on an image portion F under the action of the electric field for development, producing a toner image F at the downstream side of the developing zone. Generally, the linear velocity of the sleeve is higher than the linear velocity of the drum 1, so that preselected image density is achievable.

Figure 4A:
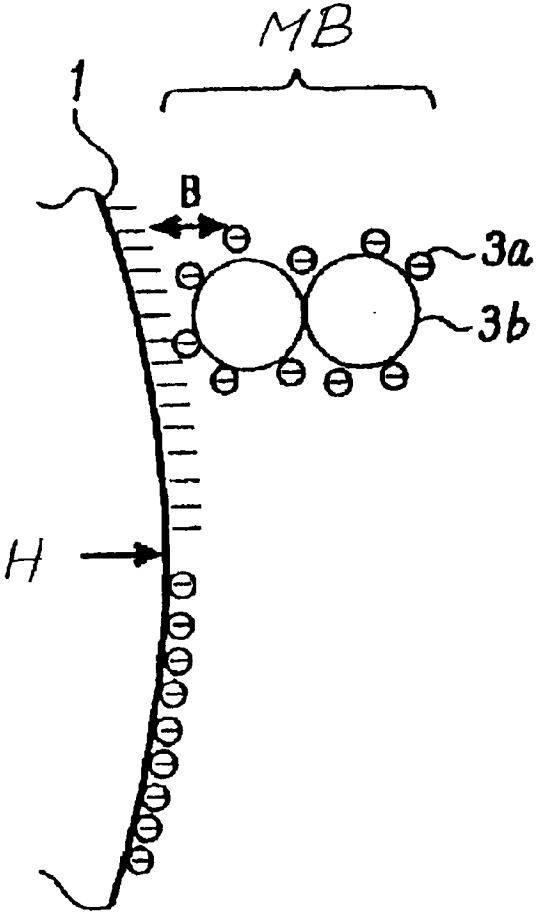
FIGS. 4A through 4C are views for describing why the trailing edge of an image is lost.
Figure 4B:
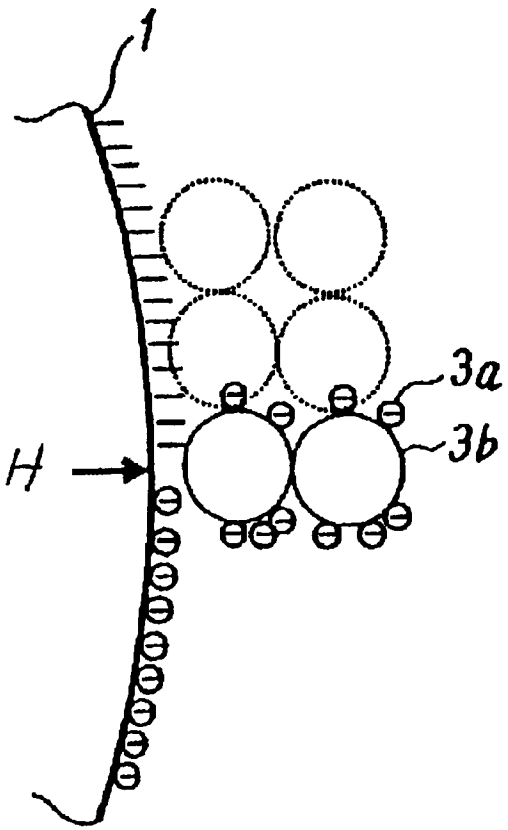
Figure 4C:
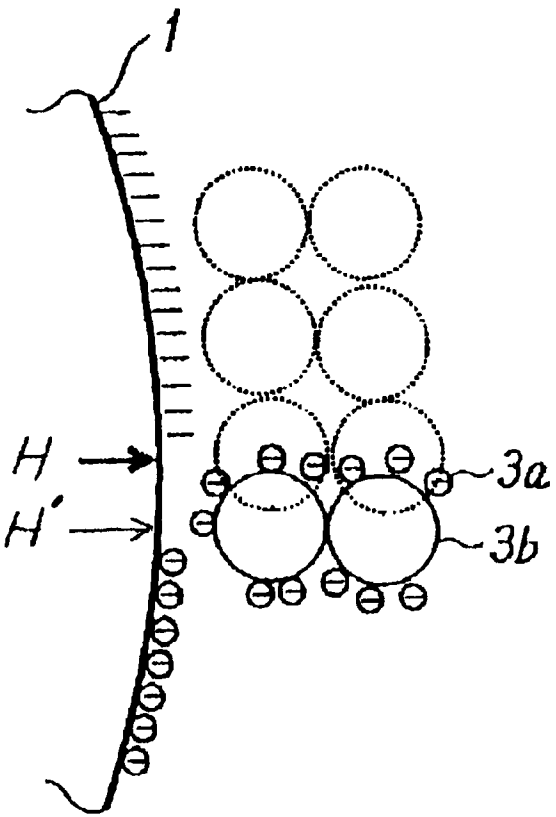

FIGS. 4A through 4C show the portion where the drum 1 and sleeve 4 face each other in an enlarged scale and demonstrate a mechanism that presumably brings about the omission of the trailing edge of an image. More specifically, FIGS. 4A through 4C show how the tip of the magnet brush MB approaches the drum 1 with the elapse of time. In FIGS. 4A through 4C, the magnet brush MB is shown as developing a boundary between a non-image portion and a black solid image, i.e., in a condition that is apt to bring about the omission of the trailing edge of an image. A toner image just formed is positioned on the drum 1 at the downstream side in the direction of rotation of the drum 1. A single brush chain MB formed on the sleeve 4 approaches the drum 1. Although the drum 1 is, in practice, rotating clockwise, the brush chain MB passes the drum 1 because the sleeve 4 moves at higher linear velocity than the drum 1. This is why FIGS. 4A through 4C show the drum 1 as if it were stationary for simplicity.

As shown in FIG. 4A, the brush chain MB approaches the drum 1 while facing the non-image portion up to the trailing edge H of the image portion to be developed. At this instant, a repulsive force B acting between the negative charges causes the toner grains 3*a* to move away from the drum 1 toward the sleeve surface little by little (so-called toner drift). As a result, as shown in FIG. 4B, about the time when the brush chain MB reaches the trailing edge H of the image portion, the carrier grains 3*b* forming the brush chain MB and adjoining the drum 1 are exposed to the outside. That is, the toner grains 3*a* are absent on the surfaces of the carrier grains 3*b* that face the trailing edge H of the image portion, and therefore do not move toward the drum 1. As shown in FIG. 4C, when the brush chain MB arrives at the trailing edge H' of the image portion slightly inward the position H, and if adhesion acting between the toner grains 3*a* and the drum 1 is weak, then the toner grains 3*a* deposited on the drum 1 are likely to return to the carrier grains 3*b* due to an electrostatic force. Consequently, it is likely that the trailing edge of the image portion close to the non-image portion is not developed and is therefore lost.

Figure 5A:
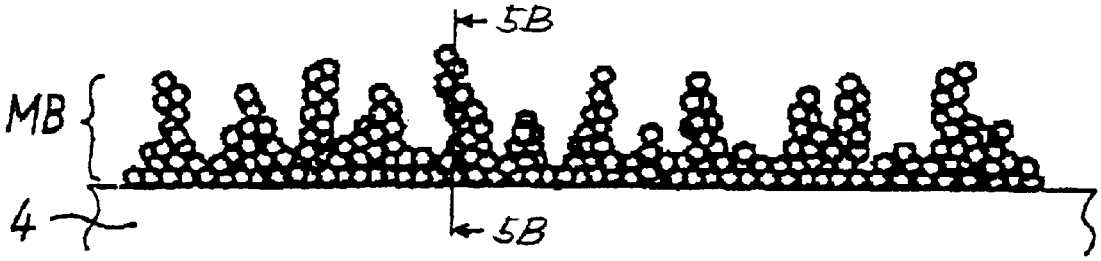
FIG. 5A PRIOR ART
FIG. 5A shows the distribution of brush chains, which constitute a magnet brush, formed in the developing zone of a conventional developing device in the axial direction of a sleeve.
Figure 5B:
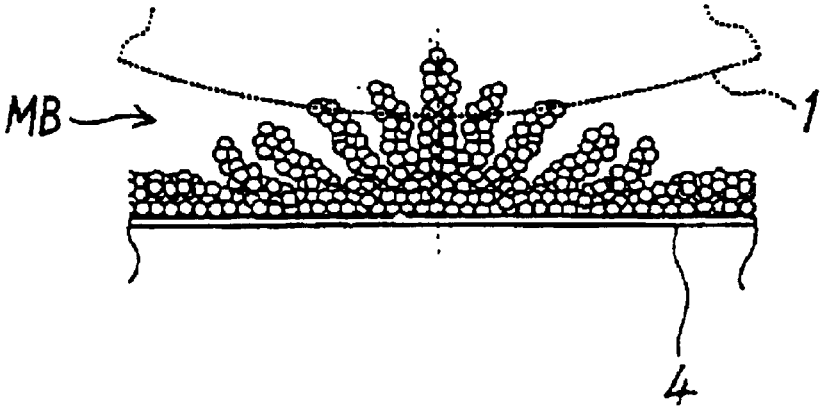
FIG. 5B is a section along line 5B—5B of FIG. 5A.

While the above description has concentrated on a section perpendicular to the axis of the sleeve 4, the brush chains constituting the magnet brush MB are different in length, or height, in the lengthwise or axial direction of the sleeve 4, as will be described hereinafter. FIG. 5A shows the magnet brush MB extending in the axial direction of the sleeve 4. FIG. 5B is a section along line 5B—5B of FIG. 5A. FIG. 5B additionally shows a relation between the magnet brush MB and the drum 1 in order to show a relation between FIG. 5B and the other figures.

Figure 6A:
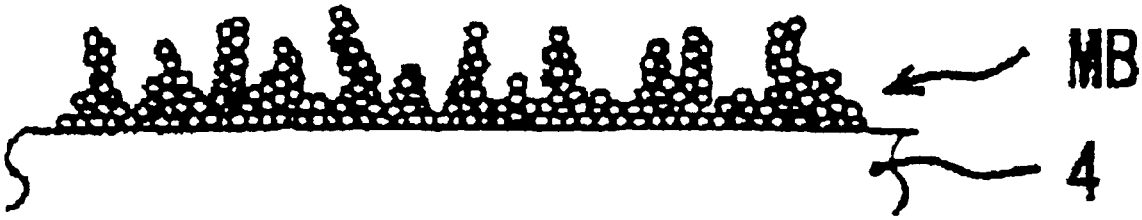
FIG. 6A PRIOR ART
FIG. 6A is a view similar to FIG. 5A, showing the distribution of brush chains in the conventional developing device.
Figure 6B:
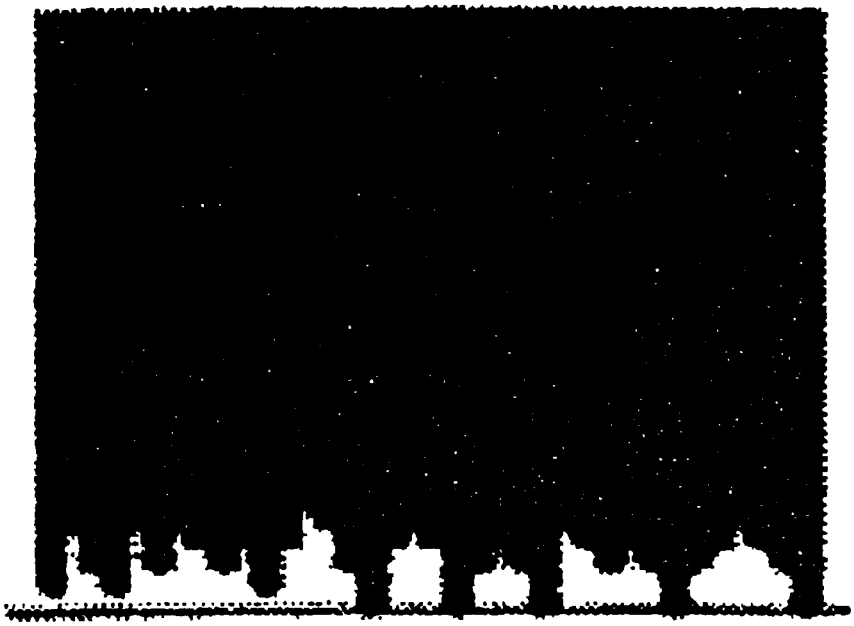
FIG. 6B shows a specific solid image whose trailing edge is locally lost.

As shown in FIGS. 5A and 6A, the brush chains constituting the magnet brush MB are noticeably different in height from each other in the axial direction of the sleeve 4 and therefore contact the drum 1 at different positions. Consequently, the degree of toner drift and therefore that of the omission of the trailing edge is irregular in the axial direction of the sleeve 4, resulting in jagged local omission shown in FIG. 6B.

Further, the mechanism described above reduces the width of horizontal thin lines extending in the axial direction of the sleeve 4 relative to the width of vertical lines perpendicular to the above direction and makes the formation of solitary dots unstable.

Reference will again be made to FIG. 1 for describing the operation of the developing device. As shown, the outer regulating member 6 regulates the thickness of the developer 3 deposited on the sleeve 4 and being conveyed in the direction B to preselected thickness. The regulated developer 3 is conveyed to the developing zone D where the sleeve 4 faces the drum 1, which is rotating in the direction A. In the developing zone D, the toner grains 3*a* are fed from the sleeve 4 to a latent image formed on the drum 1, developing the latent image to thereby produce a corresponding toner image. The developer 3 on the sleeve 4 and moved away from the developing zone D is further conveyed by the sleeve 4 to a position where it faces the opening 8*a*.

The fresh toner grains 3*a* conveyed by the agitator 9, which is disposed in the toner hopper 8, to the opening 8*a* stays in the opening 8*a* in contact with the developer. The developer 3 therefore takes in the fresh toner grains 3*a* at the opening 8*a* and then returns to the developer chamber S. Subsequently, on contacting the outer regulating member 6, the developer 3 containing the fresh toner grains 3*a* has its internal pressure increased with the result that the toner grains 3*a* are charged by friction acting between them and the carrier grains 3*b*. Part of the developer 3 blocked by the outer regulating member 6 is circulated within the developer chamber S.

Figure 7A:
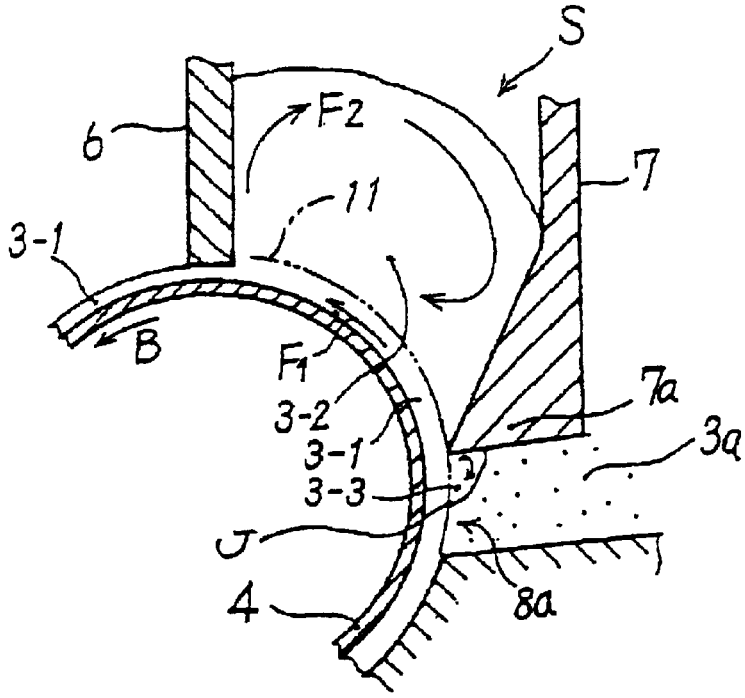
FIGS. 7A and 7B demonstrate automatic toner content control unique to the illustrative embodiment.
Figure 7B:
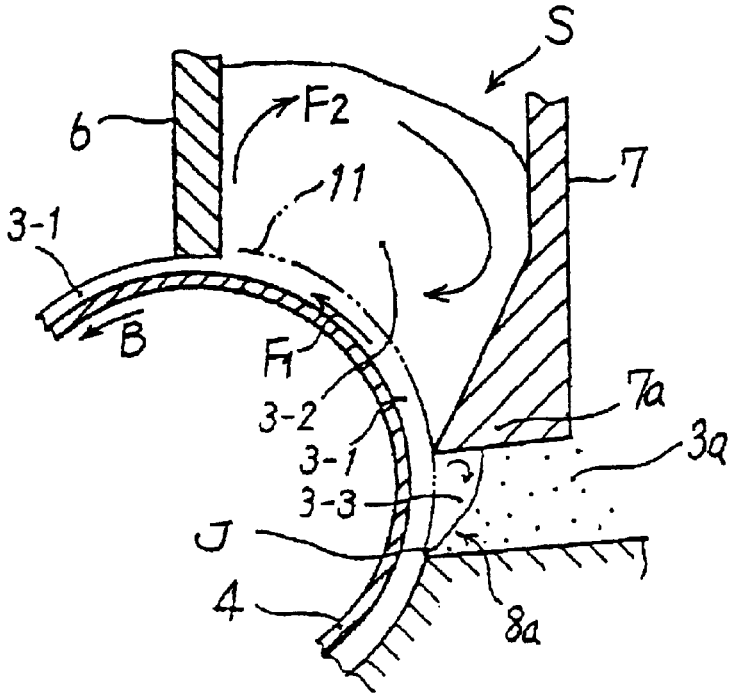

Referring to FIGS. 7A and 7B, automatic toner content control unique to the illustrative embodiment will be described. In FIGS. 7A and 7B, dash-and-dots lines 11 indicate the interface between different parts of the developer each behaving in a particular manner. First, a fresh developer 3 containing toner having preselected density and weight is initially set in the developing device. In this condition, when the sleeve 4 is caused to rotate, the developer 3 separates into two parts 3-1 and 3-2. The developer 3-1 is magnetically deposited on the sleeve 4 and conveyed by the sleeve 4 while the developer 3-2 is stored in the developer chamber S and circulated therein in accordance with the movement of the developer 3-1.

As shown in FIG. 7A, the developer in the developer chamber S forms a first and a second flow F1 and F2, respectively. More specifically, the developer 3-1 forms the flow F1 passing through the gap between the sleeve 4 and the separating member edge 7*a*. The developer 3-2 forms the flow F2 rising along the back of the outer regulating member 6 and being circulated between the outer regulating member 6 and the separating member edge 7*a*.

Subsequently, when fresh toner grains 3*a* are set in the toner hopper 8, they are replenished to the developer 3-1 deposited on the sleeve 4 via the opening 8*a*. The developer 3-1 is then conveyed to the developer chamber S. At this instant, the toner grains 3*a* replenished to the developer 3-1 slightly moves toward the axis of the sleeve 4. The developer 3-1 moved away from the separating member edge 7*a* is partly mixed with the developer 3-2 existing in the developer chamber S. Consequently, the developers 3-1 and 3-2 are replaced with each other and uniformed due to the agitation of the toner grains while having the toner grains charged by friction.

As the toner content of the developer 3 increases little by little due to the replenishment of the toner grains 3*a*, the volume of the developer 3-1 being conveyed increases. Therefore, the developer 3-1 forming a layer on the sleeve 4 increases in thickness as it moves from the position of the opening 8*a* to the position of the outer regulating member 6. At the same time, the ratio of the carrier grains to the entire developer 3-1 and therefore the magnetic force acting on the developer 3-1 decreases, so that the moving speed of the developer 3-1 is lowered. Consequently, the thickness of the developer 3-1 on the sleeve 4 further increases between the two positions mentioned above. A braking force exerted by the outer regulating member 6 on such a developer 3-1 being conveyed increases, further lowering the moving speed of the developer 3-1.

The upper portion of the developer 3-1 increased in thickness at the position of the opening 8*a* is shaved off by the separating member edge 7*a*. As shown in FIG. 7A, the developer so shaved off accumulates at the upstream side of the separating member edge 7*a* in the direction of developer conveyance. Let this part of the developer be referred to as an accumulated developer 3—3. The accumulated developer 3—3 is circulated in accordance with the movement of the developer 3-1 contacting it. The toner grains 3*a* present in the opening 8*a* is attracted toward the exposed portion of the developer 3-1 and introduced into the developer 3-1 in such a manner as to be pulled in at a joining point J.

As shown in FIG. 7B, when the toner content of the developer 3 further increases, the accumulated toner 3—3 increases in amount and covers the exposed surface of the developer 3-1 contacting the fresh toner grains 3*a*. At the same time, the joining point J is shifted to the side upstream of the opening 8*a* in the direction of developer conveyance, and the circulation speed of the accumulated developer 3—3 in the opening 8*a* itself decreases. At this time, the replenishment of the toner grains 3*a* to the developer 3-1 substantially ends, so that the toner content of the developer 3-1 stops increasing.

Part of the developer 3-1 (upper portion) moved away from the gap between the separating member edge 7*a* and the sleeve 4 is mixed with the developer 3-2 and again partly deposited on the sleeve 4. The developer 3-1 moved away from the gap between the sleeve 4 and the outer regulating member 6 is conveyed to the developing zone D. In the developing zone D, the toner grains are transferred from the sleeve 4 to the drum 1, developing a latent image formed on the drum 1.

The toner content of the developer 3-1 on the sleeve 4 decreases in the developing zone D due to development. As a result, the conveying force of the sleeve 4 acting on the developer 3-1 and the volume of the developer 3-1 increase. It follows that the thickness of the developer 3-1 regulated by the separating member edge 7*a* decreases, causing the amount and the circulation speed of the accumulated developer 3—3 around the opening 8*a* to decrease.

As stated above, the condition in which the separating member edge 7*a* regulates the developer 3-1 on the sleeve 4 varies in accordance with the toner content of the developer chamber S. The toner content of the developer is therefore automatically controlled to remain in a preselected range despite the consumption in the developing zone D. This makes a toner content sensor, a toner replenishing member and other extra members for toner content control needless.

If desired, a peeling member may be disposed in the developer chamber S in such a manner as to face the surface of the drum 4 for peeling off part of the developer 31 and mixing it with the developer 3-2 present in the chamber S. The peeling member promotes the replacement of the developers 3-1 and 3-2 for thereby slowing down the deterioration of the developer 3 ascribable to the fall of the chargeability of the carrier grains contained in the developer 3. Further, the mixture of the developers 3-1 and 3-2 uniforms the toner content of the developer in the direction perpendicular to the direction of developer conveyance by scattering the toner grains, thereby implementing desirable development free from irregular image density.

Hereinafter will be described the composition of the developer with which the illustrative embodiment is practicable. The toner of the developer should preferably have the following property in order to reduce toner scattering when the toner content increases during automatic toner content control described above, which causes the toner content to vary over a relatively broad range.

The toner should preferably have a weight mean grain size of 4 $\mu$m to 15 $\mu$m, as measured by the following procedure. First, 0.1 ml to 5 ml of surfactant, e.g., alkylbenzene sulfonate is added to 100 ml to 150 ml of electrolytic aqueous solution as a dispersant. The electrolytic aqueous solution is an about 1% NaCl aqueous solution prepared by use of primary sodium chloride and may be implemented by, e.g., ISOTON-II (trade name) available from Coulter. Subsequently, 2 mg to 20 mg of sample to be measured is added to the above mixture. The electrolytic solution containing the sample is dispersed for about 1 minute to 3 minutes by an ultrasonic dispersing device. Thereafter, an analyzer E-SPART ANALYZER (trade name) available from HOSOKAWA MICRON is used to measure the volume and number of toner grains or toner via a 100 $\mu$m aperture. The resulting distribution derives the weight mean grain size (D4) and the number mean grain size of the toner.

For the measurement, there are used thirteen channels in total, i.e., 2.00 $\mu$m to less than 2.52 $\mu$m, 2.52 um to less than 3.17 $\mu$m, 2.17 $\mu$m to less than 4.00 $\mu$m, 4.00 $\mu$m to less than 5.04 $\mu$m, 5.04 $\mu$m to less than 6.35 $\mu$m, 6.35 $\mu$m to less than 8.00 $\mu$m, 8.00 $\mu$m to less than 10.08 $\mu$m, 10.08 $\mu$m to less than 12.70 $\mu$m, 12.70 $\mu$m to less than 16.00 $\mu$m, 16.00 $\mu$m to less than 20.20 $\mu$m, 20.20 $\mu$m to less than 25.40 $\mu$m, 25.40 $\mu$m to less than 32 $\mu$m, and 32.00 $\mu$m to less than 40.30 $\mu$m. Grains sizes of 2.00 $\mu$m or above, but 40.30 $\mu$m or below, are dealt with.

The toner contains 75% to 93% of binder resin, 3% to 10% of coloring agent, 3% to 8% of parting agent, and 1% to 7% of other components. For the binder resin, use may be made of a monomer of polystyrene, poly-p-chlorostyrene, polyvinyl toluene or similar styrene or a substitute thereof, styrene-p-chlorostyrene copolymer, styrene-vinyltoluene copolymer, styrene-vinylnaphthalene copolymer, styrene-acrylate copolymer, styrene-methacrylate copolymer, styrene-$\alpha$-chloromethacrylate copolymer, styrene-acrylonitrile copolymer, styrene-vinylmethyl ether copolymer, styrene-vinylethyl ether copolymer or styrene-vinylmethyl ketone.

The coloring agent may be implemented by any one of conventional organic or inorganic dyes and/or pigments including carbon black, Aniline Black, Acetylene Black, Naphthol Yellow, Hanza Yellow, Rhodamin Lake, Alizarine Lake, Bengal, Phthalocyanine Blue, and Indus Blue.

As for a magnetic substance to be contained in the binder resin, use may be made of magnetite, $\gamma$-iron oxide, ferrite iron, excess type ferrite or similar iron oxide, iron, cobalt, nickel or similar magnetic metal or a metal oxide alloy or a mixture of iron oxide or magnetic metal and any one of cobalt, tin, titanium, copper, lead, zinc, magnesium, manganese, aluminum, silicon and so forth. The grains of such a magnetic substance should preferably have a mean grain size of 0.05 $\mu$m to 1.0 $\mu$m, more preferably 0.1 $\mu$m to 0.6 $\mu$m or even more preferably 0.1 $\mu$m to 0.4 $\mu$m. The individual grain should preferably have a BET specific surface area of 1 $m^2/g$ to 20 $m^2/g$, particularly 2.5 $m^2/g$ to 12 $m^2/g$, as measured by a nitrogen absorption method and Morse hardness of 5 to 7.

While the individual grain of the magnetic substance may have an octagonal, hexagonal, spherical, needle-like or scale-like shape, an octagonal, hexagonal or spherical shape involving a minimum of anisotropy is desirable.

The toner grains should preferably contain the above magnetic substance by 10 parts by mass to 150 parts by mass, particularly 20 parts by mass to 120 parts by mass, for 100 parts by mass of binder resin.

A small amount of additives may be added to the toner so long as they do not adversely influence the toner. The additives include Teflon powder, zinc stearate powder, polyvinylidene fluoride powder or similar lubricant powder, cesium oxide powder, silicon carbide powder, strontium titanate or similar abrasive, titanium oxide powder, aluminum oxide powder or similar fluidizing agent or anti-caking agent, carbon black powder, zinc oxide powder, tin oxide powder or similar conduction agent, and organic or inorganic fine grains of opposite polarity.

The parting agent, which improves the fixing ability as well as other abilities, may be any one of paraffin wax and derivatives thereof, microcrystalline wax and derivatives thereof, polyolefin wax and derivatives thereof, and carnauba wax and derivatives thereof. The derivatives include oxides, block copolymers with polyvinyl monomers, and graft modifications of vinyl monomers. Further, use maybe made of alcohol, fatty acid, acid amide, ester, ketone, hardened castor oil or a derivative thereof, vegetable wax, animal wax, mineral wax or petrolactam.

The charge control agent applicable to the illustrative embodiment charges the toner to either one of negative polarity and positive polarity. The charge control agent charging the toner to negative polarity may be effectively implemented by any one of, e.g., organic metal complexes and chelate compounds. For example, there may be used a mono-azo metal complex, an acetyl acetone metal complex, an aromatic hydroxycarboxylic acid or an aromatic dicarboxylic acid. Further, use may be made of an aromatic hydrycarboxylic acid, an aromatic mono or polycarboxylic acid or a metal salt, an anhydride or an ester thereof or a bisphenol or similar phenol derivative.

The charge control agent charging the toner to positive polarity may be, e.g., Nigrosine or a modulation modulated by fatty acid metal or tributylbenzil ammonium-hydroxy-4-naphthosulfonate, tributylammonium tetrafluoroborate or similar quaternary ammonium salt or phosphonium salt or similar onium salt or lake pigment or triphenylmethane dye thereof. A lake agent may be phosphorous tungstate, phosphorus molybdate, phosphorous tungsten-molybdenate, tannic acid, lauric acid, ferricyanide or ferrocyanide. The fine grains of charge control agent should preferably have a number mean grain size of 4 $\mu$m or below, more preferably 3 $\mu$m or below. When the toner grains contain such a charge control agent therein, the content of the charge control agent should preferably be 0.1 part by mass to 20 parts by mass, more peferably 0.2 part by mass to 10 parts by mass, for 100 parts by pass of binder resin.

The toner may additionally include additives generally applied to toner, e.g., a colloidal silica or similar fluidizing agent, titanium oxide, aluminum oxide or similar metal oxide or silicon carbide or similar abrasive, and a fatty acid metal salt or similar lubricant. The content of the inorganic fine grains to the toner should preferably be 0.1 mass % to 2 mass %. Contents below 0.1 mass % fail to fully obviate toner cohesion while contents above 2 mass % are apt to bring about toner scattering between thin lines, contamination inside the printer, and scratches and wear of the drum.

To mix the additives mentioned above, use may be made of any conventional device, e.g., a Henschel mixer or a speed kneader. To powder the toner kneaded and then cooled, use may be made of a conventional jet mill.

When the toner is implemented as a dry two-ingredient type developer, the carrier grains and toner grains should preferably be mixed such that the toner grains deposit on each carrier grain over 30% to 100% of the surface area of the toner grain.

The core grain of the individual carrier grain may be implemented by iron, cobalt, nickel or similar ferromagnetic metal, an alloy or a compound of magnetite, hematite or ferrite or a compound of the ferromagnetic grains and resin. Such carrier grains should preferably be coated with resin to achieve durability.

The resin forming the coating layer may be, e.g., polyethylene, polypropylene, chlorinated polyethylene, chlorosulfonated polyethylene or similar polyolefin resin, polystyrene, acryl (e.g. polymethyl metacrylate), polyacrylonitrile, polyvinyl acetate, polyvinyl alcohol, polyvinyl butyral, polyvinyl chloride, polyvinyl carbazol, polyvinyl ether, polyvinyl ketone or similar polyvinyl or polyvinylidene resin, vinyl chloride-vinyl acetate copolymer, silicone resin with organosiloxane bond or a modulation thereof (modulated by, e.g., alkyd resin, polyester resin, epoxy resin or polyurethane), polytetrafluoroethylene, polyvinyl fluoride, polychlorotrifluoroethylene or similar flurocarbon resin, polyamide, polyester, polyurethane, polycarbonatre, urea-formaldehyde or similar amino resin or epoxy resin. Among them, silicone resin or a modulation thereof, fluorocarbon resin, particularly the former, is desirable from the toner spent standpoint.

The coating layer may be formed by spraying a coating layer forming liquid on the surfaces of the carrier grains or by immersing the carrier grains in such a liquid as conventional.

Specific examples of a method of producing a two-ingredient type developer made up of toner and carrier stated above are as follows.

EXAMPLE 1

As for the magnetic toner, there was prepared a mixture of 100 parts by mass of polyester resin (weight mean grain size of 300 μm and softening point of 80.2° C.), 10 parts by mass of carbon black, 60 parts by mass of magnetite, 5 parts by mass of polypropylene (weight mean grain size of 180 μm), and 2 parts by mass of quaternary ammonium salt. The mixture was kneaded, pulverized, and then classified. Thereafter, 0.3 parts by mass of hydrophobic silica was mixed to thereby produce toner grains having a mean grain size of 9.0 μm.

As for the magnetic carrier, 2 parts by mass of polyvinyl alcohol and 60 parts by mass of water was mixed with 100 parts by mass of magnetite, which was produced by a wet process, and mixed together for 12 hours in a ball mill. The resulting magnetite slurry was sprayed by a spray dryer to be thereby transformed to spherical grains. The spherical grains were sintered at 1,000° C. for 3 hours in a nitrogen atmosphere and then cooled to produce core grains.

To prepare a coating layer forming liquid, there was produced a mixture of 100 parts by mass of silicone resin solution, 100 parts by mass of toluene, 15 parts by mass of γ-aminopropyl trimethoxysilane, and 20 parts by mass of carbon black. The mixture was dispersed for 20 minutes in a homo mixer. The coating layer forming liquid was coated on the surfaces of 100 parts by mass of the core grains by use of a fluidized-bed type coating device, thereby completing the carrier grains.

10 parts by mass of the toner grains were mixed with 90 parts by mass of the carrier grains to thereby produce a two-ingredient type developer.

The auxiliary poles P1*a* and P1*b* opposite in polarity to the main pole P1 serve to reduce the angular half width of the flux density distribution formed by the main pole P1 in the normal direction for the purpose stated earlier. Specifically, if the forces of the auxiliary electrodes P1*a* and P1*b* for retaining the developer yield to a centrifugal force when the sleeve 4 is in rotation, the developer is likely to fly-about release and contaminate the inside of the printer or developed images.

Figure 8A:
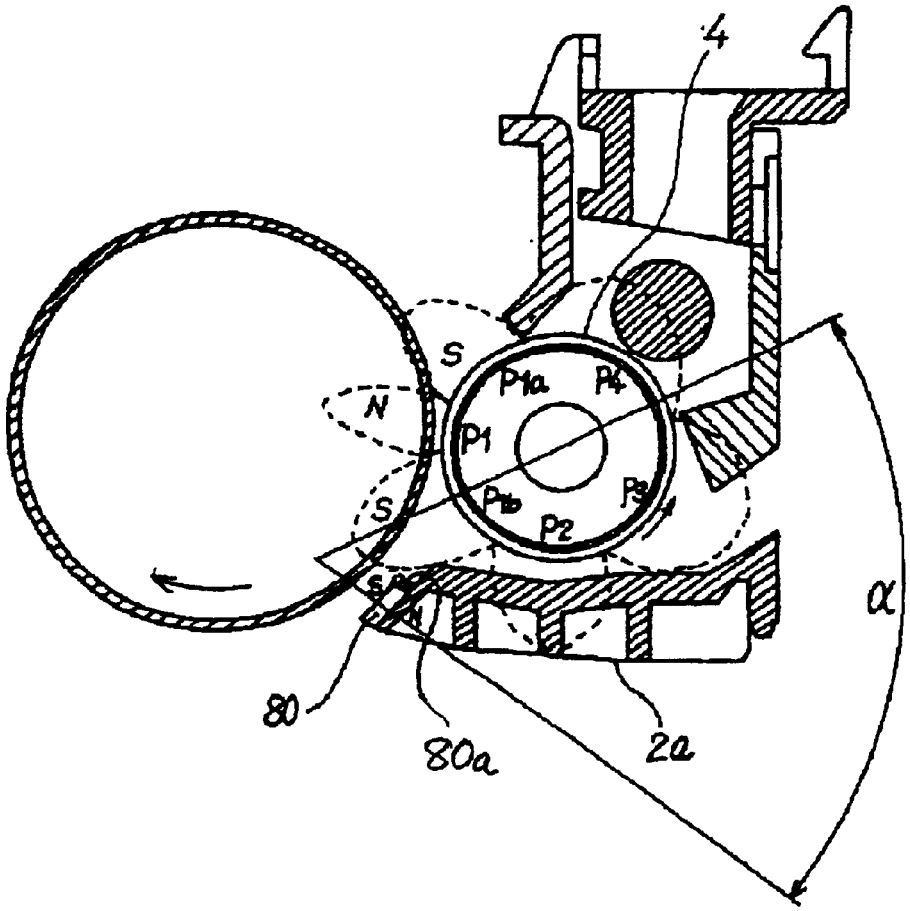
FIG. 8A shows magnetic field forming means included in the developing device of the illustrative embodiment.

To solve the above problem, as shown in FIG. 8A, the illustrative embodiment additionally includes a collection magnetic pole or electric field forming means 80 implemented by a ferrite magnet or a ferrite bond-magnet by way of example. The collection pole 80 is positioned on one edge of the opening, which is formed in the casing 2*a* of the developing device and faces the drum 1. The collection pole 80 is positioned in the vicinity of the auxiliary pole P1*b* opposite in polarity to the main pole P1.

Figure 9:
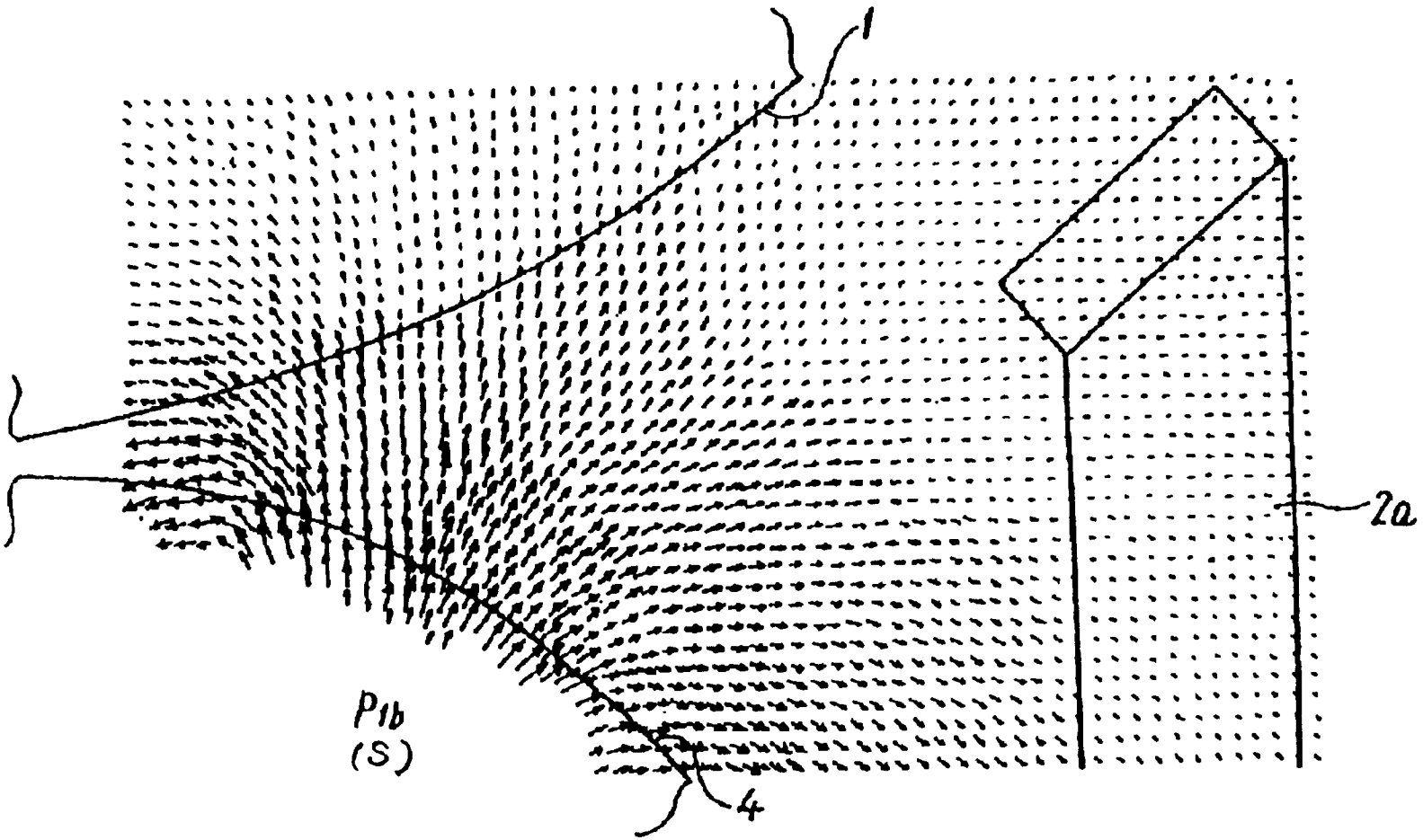
FIG. 9 shows the result of simulation with a magnetic field in which the magnetic field forming means was absent.
Figure 10:
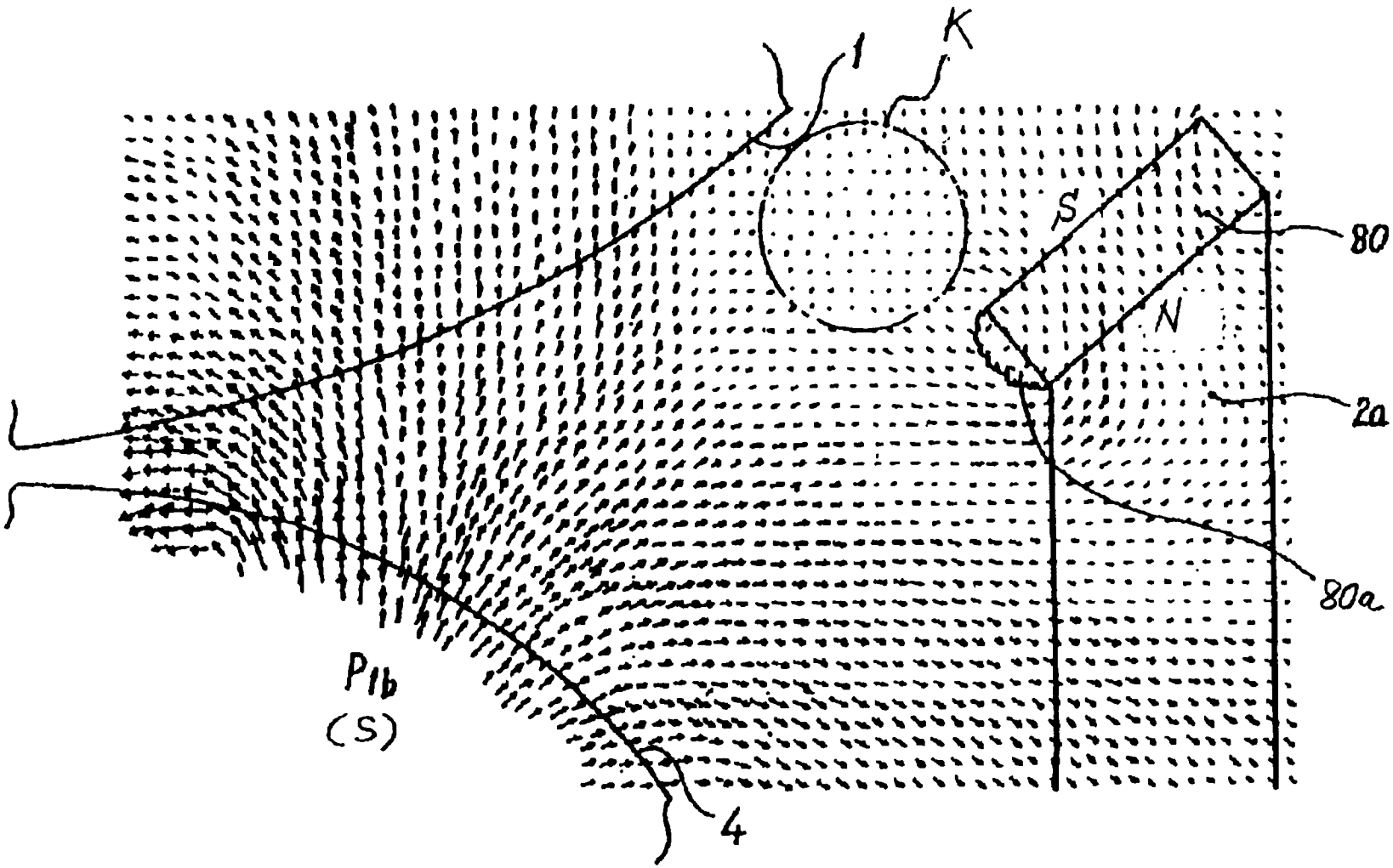
FIG. 10 shows the result of simulation with a magnetic field in which the magnetic field forming means was present.

FIG. 9 shows a magnetic field determined by simulation in the absence of the collection pole 80 on the casing 2*a*. In FIG. 9, directions indicated by arrows indicate the magnetic field while the lengths of the arrows indicate field strength. FIG. 10 shows a magnetic field determined by simulation in the presence of the collection pole 80 on the casing 2*a*. In FIG. 9, the vector of the magnetic field is small in a portion labeled K. It is to be noted that FIGS. 9 and 10 are views as seen from the rear of FIG. 8A; the casing 2*a* is positioned vertically downward.

Figure 11C:
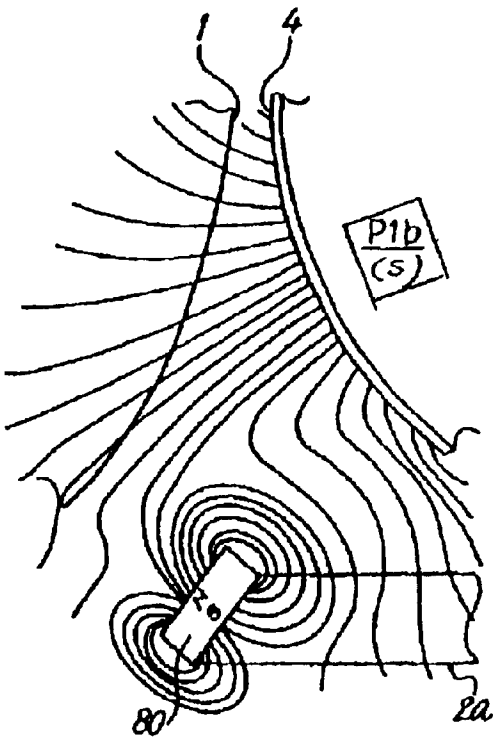
FIGS. 11A through 11C each show magnetic lines of force in a particular condition.
Figure 11B:
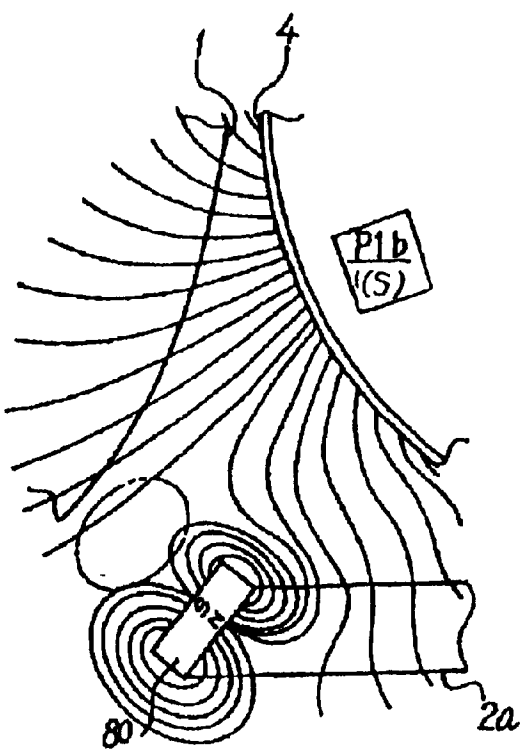
Figure 11A:
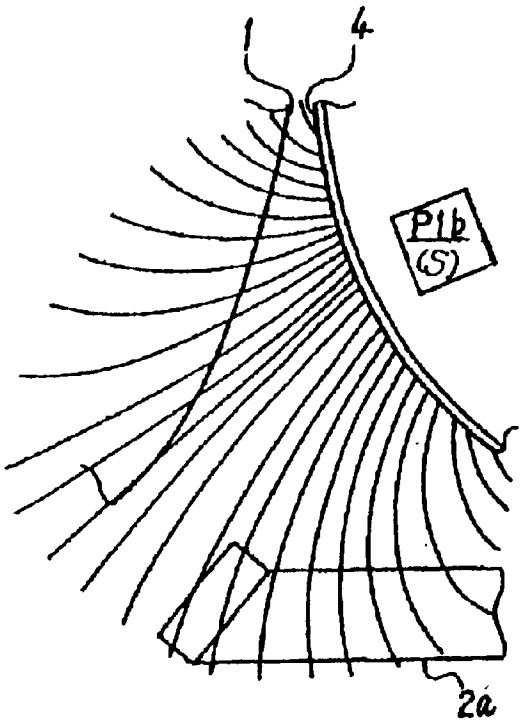

FIGS. 11A through 11C each show particular magnetic lines of force around the auxiliary pole P1*b*. More specifically, FIG. 11A shows the conventional arrangement lacking the collection pole 80 while FIG. 11B shows the arrangement of the illustrative embodiment including the collection pole 80. FIG. 11C shows a comparative example similar to the arrangement of FIG. 11B except that the collection pole 80 is inverted in position with respect to N and S.

It will be seen that the field strength is weaker, i.e., the arrows are shorter or the flux density is lower in a portion indicated by a dash-and-dots line in FIG. 10 or 11B, which intervenes between the drum and the collection pole 80, than in FIG. 9 or 11A. It was experimentally found that the developer released to the above particular portion was attracted by the other portion having higher flux density and closer to the collection pole 80 and accumulated on the side 80*a* of the pole 80, without escaping.

In the comparative example shown in FIG. 11C, flux density around the collection pole 80 was substantially uniform and was not high enough to attract the developer falling away from the sleeve 4 toward the collection pole 80, preventing the collection pole 80 from fully collecting the developer.

Figure 8B:
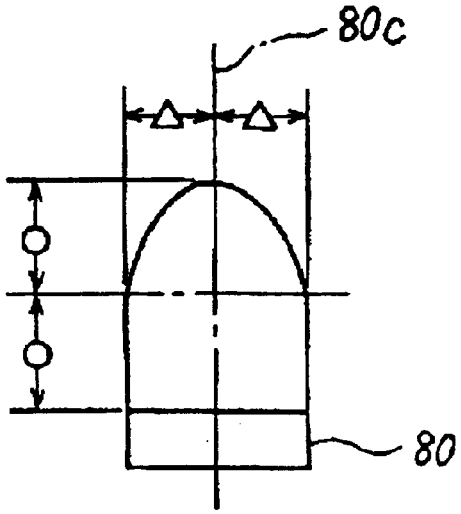
FIG. 8B is a view for describing the center line of a collection magnetic pole included in the developing device of the illustrative embodiment.

As shown in FIG. 8A, assume a line connecting the axis of the sleeve 4 and the auxiliary pole P1*b* and extended to the pole P1*b* side and the center line of the collection pole 80 extended to the same polarity side as the pole P1*b*. Then, the collection pole 80 is positioned such that the angle $\alpha$ between the two lines is 45° or above, but 90° or below. A series of experiments showed that such a position of the collection pole 80 allowed the developer falling away from the sleeve 4 to desirably deposit on the side 80*a* of the collection pole 80. As shown in FIG. 8B, the center line of the collection pole 80 refers to a line 80*c* positioned at the center of an angle between points where the flux density is one-half of the maximum flux density as to a magnetic waveform distribution.

Again, the field strength is weaker in the portion, FIG. 10, between the drum 1 and the collection pole 80 than in the other portion around the collection pole 80. Therefore, the developer falling to this portion is attracted by the other portion around the collection pole 80 and collected by the pole 80. A desirable result was achieved when the field strength implemented by the auxiliary electrode P1*b* and the field strength implemented by the collection electrode 80 were 70 mT to 80 mT and 20 mT to 50 mT, respectively.

When the angle $\alpha$ did not lie in the particular range described above, the collection pole 80 could not sufficiently collect the developer falling away from the sleeve 4 and failed to fully prevent it from escaping the developing device.

Figure 12:
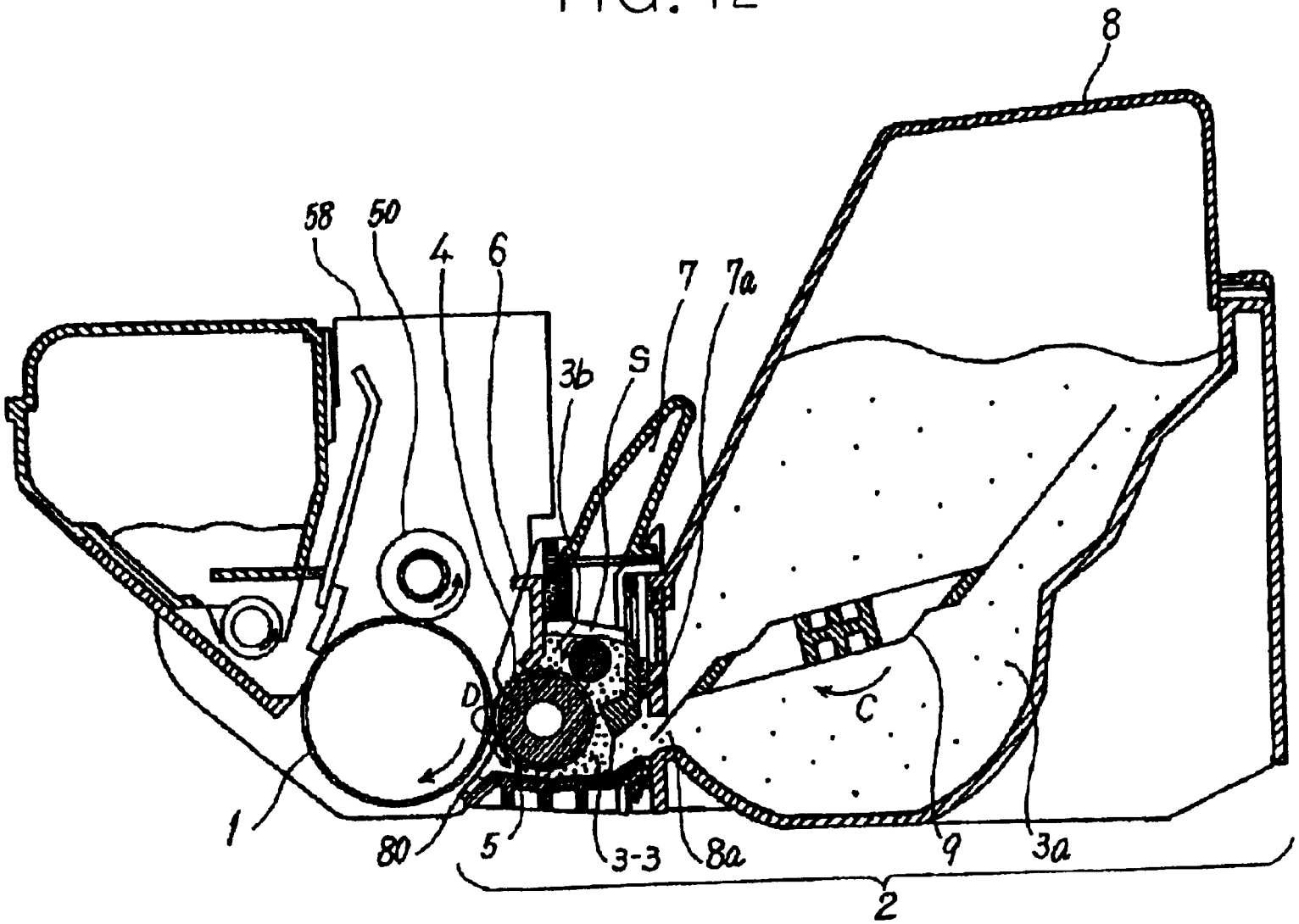
FIG. 12 shows a specific configuration of a process cartridge available with the illustrative embodiment.

In the illustrative embodiment, at least one of the drum, charge roller 50 and cleaning unit 58 and the developing device 2 may be constructed into a single image forming process unit (process cartridge hereinafter). FIG. 12 shows a specific configuration of such a process cartridge. As shown, the drum 1, charge roller 50, cleaning unit 58 and developing device 2 all are constructed into a single process cartridge removably mounted to the printer body.

When the process cartridge lacking the collection pole 80 was mounted to a test machine and driven by the machine for 30 minutes alone, 300 mg of developer dropped from the process cartridge. By contrast, when the collection pole 80 was included in the process cartridge, the amount of the developer dropped from the process cartridge was substantially 0 mg (unable to measure).

Five process cartridges each having the above configuration were individually operated to produce 30,000 prints exceeding 20,000 prints, which was the life of the individual process cartridge; toner was replenished after the end of toner. Measurements after the operation showed that the developer deposited on the side 80*a* of each collection pole 80 was 0.6 g to 1 g. Each process cartridge is loaded with about 75 g of developer, so that the amount of developer deposited on the collection pole 80 is 0.8% to 1.3% of the entire developer. Such an amount did not bring about background contamination or similar defect or cause the developer to drop from the process cartridge.

The illustrative embodiment has concentrated on the direct transfer of a toner image from the drum 1 to a sheet. The present invention is similarly applicable to an image forming apparatus of the type including an intermediate image transfer body via which a toner image is transferred from a photoconductive element to a sheet as well as to a developing device included in such an image forming apparatus. A color image forming apparatus of this type is configured to transfer toner images of different colors sequentially formed on a single photoconductive element from the element to an intermediate image transfer belt one above the other and then transfer the resulting color image from the belt to a sheet.

On the other hand, a tandem color image forming apparatus is configured to sequentially transfer toner images of different colors from a plurality of image forming units to an intermediate image transfer belt one above the other and then transfer the resulting color image from the belt to a sheet.

The present invention is, of course, applicable not only to a printer and a developing device included therein, but also to any other image forming apparatus, e.g., a copier or a facsimile apparatus and a developing device included therein.

In summary, in accordance with the present invention, magnetic field forming means magnetically collects the magnetic grains of a developer falling away from a developer carrier and magnetically causes such magnetic grains to be collected in storing means. Therefore, the developer falling from the developer carrier is prevented from escaping a developing device and contaminating structural elements around the developing device or developed images. Further, when the developing device is included in a process cartridge removably mounted to the body of an image forming apparatus, not only the developer is prevented from being scattered around, but also the omission of the trailing edge of an, image and other image defects are obviated.

Various modifications will become possible for those skilled in the art after receiving the teachings of the present disclosure without departing from the scope thereof.

What is claimed is:

1. An image forming apparatus comprising:

an image carrier;

a latent image forming means for forming a latent image on said image carrier; and a developing device for developing the latent image to thereby produce a corresponding toner image; said developing device comprising:

storing means for storing a developer consisting of toner and magnetic grains, said storing means being formed with an opening facing said image carrier;

toner content controlling means for controlling toner content without using a toner content sensor or toner replenishing member;

a rotatable developer carrier formed of a nonmagnetic material and supported in said storing means; and magnetic field generating means for causing the developer to rise in a form of a magnet brush on said developer carrier in a developing zone that faces said image carrier;

said magnetic field generating means comprising a main magnetic pole positioned inward of said developer carrier with respect to the developing zone and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents the developer falling away from said developer carrier from flowing out of said developing device via said opening;

wherein the magnet brush on said developer carrier is moved in a same direction as a surface of said image carrier, as viewed in the developing zone, but at a higher speed than said surface of said image carrier in contact with said surface of said image carrier, thereby developing the latent image.

2. The apparatus as claimed in claim 1, wherein said magnetic field forming means comprises a collection magnetic pole adjoining an edge of said opening of said storing means and positioned such that flux density is higher in a portion closer to said collection magnetic pole than in at least one portion around said collection magnetic pole.

3. The apparatus as claimed in claim 2, wherein said magnetic field forming means has a weaker magnetic force than said auxiliary magnetic pole.

4. The apparatus as claimed in claim 1, wherein said magnetic field forming means comprises a collection magnetic pole adjoining an edge of said opening of said storing means and positioned such that an angle between a line connecting an axis of said developer carrier and said auxiliary magnetic pole and extended to an auxiliary magnetic pole side and a center line of said collection magnetic pole extended to a same polarity side as said collection magnetic pole is 45° or above, but 90° or below.

5. The apparatus as claimed in claim 4, wherein said magnetic field forming means has a weaker magnetic force than said auxiliary magnetic pole.

6. The apparatus as claimed in claim 1, wherein said magnetic field forming means has a weaker magnetic force than said auxiliary magnetic pole.

7. A process cartridge removably mounted to a body of an image forming apparatus and including an image carrier and at least one of charging, developing means and cleaning means, said developing means comprising:

storing means for storing a developer consisting of toner and magnetic grains, said storing means being formed with an opening facing the image carrier;

a rotatable developer carrier formed of a nonmagnetic material and supported in said storing means; and magnetic field generating means for causing the developer to rise in a form of a magnet brush on said developer carrier in a developing zone that faces the image carrier;

said magnetic field generating means comprising a main magnetic pole positioned inward of said developer carrier with respect to the developing zone; and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents the developer falling away from said developer carrier from flowing out of said developing device via said opening;

wherein the magnet brush on said developer carrier is moved in a same direction as a surface of said image carrier, as viewed in the developing zone, but at a higher speed than said surface of said image carrier in contact with said surface of said image carrier, thereby developing the latent image.

8. An image forming apparatus comprising:

an image carrier;

a latent image forming means for forming a latent image on said image carrier; and a developing device for developing the latent image to thereby produce a corresponding toner image; said developing device comprising:

storing means for storing a developer consisting of toner and magnetic grains, said storing means being formed with an opening facing said image carrier;

a rotatable developer carrier formed of a nonmagnetic material and supported in said storing means; and magnetic field generating means for causing the developer to rise in a form of a magnet brush on said developer carrier in a developing zone that faces said image carrier;

said magnetic field generating means comprising a main magnetic pole positioned inward of said developer carrier with respect to the developing zone and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents developer falling away from said developer carrier from flowing out of said developing device via said opening;

wherein the magnet brush on said developer carrier is moved in a same direction as a surface of said image carrier, as viewed in the developing zone, but at a higher speed than said surface of said image carrier in contact with said surface of said image carrier, thereby developing the latent image;

wherein said magnetic field forming means comprises a collection magnetic pole adjoining an edge of said opening of said storing means and positioned such that flux density is higher in a portion closer to said collection magnetic pole than in at least one portion around said collection magnetic pole.

9. The apparatus as claimed in claim 8, wherein said magnetic field forming means has a weaker magnetic force than said auxiliary magnetic pole.

10. The apparatus as claimed in claim 8, wherein said magnetic field forming means comprises a collection magnetic pole adjoining an edge of said opening of said storing means and positioned such that an angle between a line connecting an axis of said developer carrier and said auxiliary magnetic pole and extended to an auxiliary magnetic pole side and a center line of said collection magnetic pole extended to a same polarity side as said collection magnetic pole is 45° or above, but 90° or below.

11. The apparatus as claimed in claim 10, wherein said magnetic field forming means has a weaker magnetic force than said auxiliary magnetic pole.

12. An image forming apparatus comprising:

an image carrier;

a latent image forming means for forming a latent image on said image carrier, and a developing device for developing the latent image to thereby produce a corresponding toner image; said developing device comprising:

storing means for storing a developer consisting of toner and magnetic grains, said storing means being formed with an opening facing said image carrier;

a rotatable developer carrier formed of a nonmagnetic material and supported in said storing means; and magnetic field generating means for causing the developer to rise in a form of a magnet brush on said developer carrier in a developing zone that faces said image carrier;

said magnetic field generating means comprising a main magnetic pole positioned inward of said developer carrier with respect to the developing zone and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents developer falling away from said developer carrier from flowing out of said developing device via said opening;

wherein the magnet brush on said developer carrier is moved in a same direction as a surface of said image carrier, as viewed in the developing zone, but at a higher speed than said surface of said image carrier in contact with said surface of said image carrier, thereby developing the latent image;

wherein said magnetic field forming means comprises a collection magnetic pole adjoining an edge of said opening of said storing means and positioned such that flux density is higher in a portion closer to said collection magnetic pole than in at least one portion around said collection magnetic pole;

wherein said magnetic field forming means has a weaker magnetic force than said auxiliary magnetic pole.

13. The apparatus as claimed in claim 12, wherein said magnetic field forming means comprises a collection magnetic pole adjoining an edge of said opening of said storing means and positioned such that an angle between a line connecting an axis of said developer carrier and said auxiliary magnetic pole and extended to an auxiliary magnetic pole side and a center line of said collection magnetic pole extended to a same polarity side as said collection magnetic pole is 45° or above, but 90° or below.

14. An image forming apparatus comprising:

an image carrier;

a latent image forming means for forming a latent image on said image carrier; and a developing device for developing the latent image to thereby produce a corresponding toner image; said developing device comprising:

storing means for storing a developer consisting of toner and magnetic grains, said storing means being formed with an opening facing said image carrier;

a rotatable developer carrier formed on a nonmagnetic material and supported in said storing means; and magnetic field generating means for causing the developer to rise in a form of a magnetic brush on said developer carrier in a developing zone that faces said image carrier;

said magnetic field generating means comprising a main magnetic pole positioned inward of said developer carrier with respect to the developing zone and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents developer falling away from said developer carrier from flowing out of said developing device via said opening;

wherein the magnetic brush on said developer carrier is moved in a same direction as a surface of said image carrier, as viewed in the developing zone, but at a higher speed than said surface of said image carrier in contact with said surface of said image carrier, thereby developing the latent image;

wherein said magnetic field forming means comprises a collection magnetic pole adjoining an edge of said opening of said storing means and positioned such that an angle between a line connecting an axis of said developer carrier and said auxiliary magnetic pole and extended to an auxiliary magnetic pole side and a center line of said collection magnetic pole extended to a same polarity side as said collection magnetic pole is 45° or above, but 90° or below.

15. An image forming apparatus comprising:

an image carrier;

a latent image forming means for forming a latent image on said image carrier; and a developing device for developing the latent image to thereby produce a corresponding toner image; said developing device comprising:

storing means for storing a developer consisting of toner and magnetic grains, said storing means being formed with an opening facing said image carrier;

a rotatable developer carrier formed of a nonmagnetic material and supported in said storing means; and magnetic field generating means for causing the developer to rise in a form of a magnet brush on said developer carrier in a developing zone that faces said image carrier;

said magnetic field generating means comprising a main magnetic pole positioned inward of said developer carrier with respect to the developing zone and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents developer falling away from said developer carrier from flowing out of said developing device via said opening;

wherein the magnetic brush on said developer carrier is moved in a same direction as a surface of said image carrier, as viewed in the developing zone, but at a higher speed than said surface of said image carrier in contact with said surface of said image carrier, thereby developing the latent image;

wherein said magnetic field forming means comprises a collection magnetic pole adjoining an edge of said opening of said storing means and positioned such that an angle between a line connecting an axis of said developer carrier and said auxiliary magnetic pole and extended to an auxiliary magnetic pole side and a center line of said collection magnetic pole extended to a same polarity side as said collection magnetic pole is 45° or above, but 90° or below;

wherein said magnetic field forming means has a weaker magnetic force than said auxiliary magnetic pole.

16. An image forming apparatus comprising:

an image carrier;

a latent image forming means for forming a latent image on said carrier; and a developing device for developing the latent image to thereby produce a corresponding toner image; said developing device comprising:

storing means for storing a developer consisting of toner and magnetic grains, said storing means being formed with an opening facing said image carrier;

a rotatable developer carrier formed of a nonmagnetic material and supported in said storing means; and magnetic field generating means for causing the developer to rise in a form of a magnetic brush on said developer carrier in a developing zone that faces said image carrier;

said magnetic field generating means comprising a main magnetic pole positioned inward of said developer carrier with respect to the developing zone and an auxiliary magnetic pole positioned downstream of said main magnetic pole in a direction of rotation of said developer carrier and opposite in polarity to said main magnetic pole;

said storing means comprising magnetic field forming means adjoining said auxiliary magnetic pole for forming a magnetic field that prevents developer falling away from said developer carrier from flowing out of said developing device via said opening;

wherein the magnetic brush on said developer carrier is moved in a same direction as a surface of said image carrier, as viewed in the developing zone, but at a higher speed than said surface of said image carrier in contact with said surface of said image carrier; thereby developing the latent image;

wherein said magnetic field forming means has a weaker magnetic force than said auxiliary magnetic pole.

* * * * *